US006173761B1

(12) United States Patent
Chandratilleke et al.

(10) Patent No.: US 6,173,761 B1
(45) **Date of Patent: *Jan. 16, 2001**

(54) CRYOGENIC HEAT PIPE

(75) Inventors: Rohana Chandratilleke, Tokyo; Yasumi Ohtani; Masahiko Takahashi, both of Yokohama; Hideki Nakagome; Tatsuya Yoshino, both of Tokyo, all of (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/857,002

(22) Filed: May 15, 1997

(30) Foreign Application Priority Data

May 16, 1996 (JP) ..... 8-121820

(51) Int. Cl.[7] ..... F28D 15/00
(52) U.S. Cl. ..... 165/104.21; 62/51.1; 62/259.2
(58) Field of Search ..... 165/104.21, 104.26; 62/508, 383, 259.2, 51.1

(56) References Cited

U.S. PATENT DOCUMENTS

| | | | | |
|---|---|---|---|---|
| 2,676,791 | * | 4/1954 | White | 165/104.21 |
| 4,020,898 | * | 5/1977 | Grover | 165/104.26 |
| 4,133,376 | * | 1/1979 | Eilenberg et al. | 165/104.21 |
| 4,240,500 | * | 12/1980 | Rohner | 165/104.21 |
| 4,509,334 | * | 4/1985 | Nakagome et al. | 165/104.21 |
| 4,640,347 | * | 2/1987 | Grover et al. | 165/104.26 |
| 4,995,450 | * | 2/1991 | Geppelt et al. | 165/104.21 |
| 5,036,908 | * | 8/1991 | Petroff et al. | 165/104.21 |
| 5,076,351 | * | 12/1991 | Munekawa et al. | 165/104.21 |
| 5,101,888 | * | 4/1992 | Sprouse et al. | 165/104.26 |
| 5,144,810 | * | 9/1992 | Nagao et al. | 62/471 |
| 5,203,399 | | 4/1993 | Koizumi . | |
| 5,219,020 | * | 6/1993 | Akachi | 165/104.26 |
| 5,303,768 | * | 4/1994 | Alario et al. | 165/104.26 |
| 5,737,927 | * | 4/1998 | Takahashi et al. | 62/383 |
| 5,842,348 | * | 12/1998 | Kaneko et al. | 62/383 |
| 5,845,702 | * | 12/1998 | Dinh | 165/104.21 |

FOREIGN PATENT DOCUMENTS

| | | | | |
|---|---|---|---|---|
| 57-131989 | * | 8/1982 | (JP) | 165/104.21 |
| 4-20788 | | 1/1992 | (JP) . | |
| 4-190090 | | 7/1992 | (JP) . | |
| 6-97147 | | 11/1994 | (JP) . | |
| 8203680 | * | 4/1981 | (WO) | 165/104.21 |

OTHER PUBLICATIONS

M. Shiraishi, Development of ultra large scale gravity assisted heat pipe, Mechanical Eng. Laboratory, Aug. 1987.*

Yu. A. Kirichenko, et al., "Heat Transfer Crisis During Liquid Nitrogen Cooling of High Temperature Superconductor", Cryogenics, vol. 31, (1991), pp. 979–984.

* cited by examiner

*Primary Examiner*—Ira S. Lazarus
*Assistant Examiner*—Terrell McKinnon
(74) *Attorney, Agent, or Firm*—Oblon, Spivak, McClelland, Maier & Neustadt, P.C.

(57) ABSTRACT

In a cryogenic loop heat pipe, a working fluid for heat transport is contained in a loop capillary tube, and a portion of the loop capillary tube is used as a heat absorbing portion (A) while a portion other than the heat absorbing portion (A) is used as a heat dissipating portion (B). In this heat pipe, when the heat exchange length of the heat absorbing portion A of the capillary tube is represented by l, and the inner diameter of the capillary tube at the heat absorbing portion A is represented by d, l and d satisfy $15d<l<882d$. When a Laplace constant L is given by $L=[\sigma/\{(\rho_1-\rho_v)g\}]^{0.5}$, the inner diameter d satisfies $L<d<3L$.

11 Claims, 12 Drawing Sheets

CRYOGENIC HEAT PIPE

BACKGROUND OF THE INVENTION

The present invention relates to a cryogenic heat pipe having a sealed tube and designed to cool an object (to be cooled) placed on the heat absorbing side by using a refrigerator installed on the heat dissipating side and, more particularly, to a cryogenic heat pipe which can efficiently perform heat transport by properly setting the inner diameter of the above tube and the length of a heat absorbing portion.

Superconductors are known to have zero electric resistance. It is expected that the energy consumed by power equipment will be saved by applying this property to power equipment.

In order to use a superconductor, it must be cooled to a critical temperature or less by some means. As a cooling means, a scheme of cooling a superconductor by immersing it in a cryogenic liquid such as liquid helium or liquid nitrogen is generally used. With such an immersion dip cooling scheme, however, since liquid helium or liquid nitrogen which is difficult to handle is used, it is inevitable that the operation cost will rise.

Under the circumstances, a direct refrigerator cooling scheme has recently been proposed, in which the cooling stage of a refrigerator is thermally connected to a superconductor through a heat conduction member to cool the superconductor.

In power superconducting equipments, however, since large currents are involved and AC is used, a larger amount of heat is generated than in DC superconducting equipment. In addition, in the power superconducting equipment, a sufficient distance must be ensured between the refrigerator and the object to be cooled owing to the large size of the equipment and the breakdown voltage. For these reasons, a large amount of heat needs to be transferred over a long distance. This makes the temperature difference between the refrigerator and the object large, resulting in a considerable deterioration in the efficiency of the system.

Demands have therefore arisen for the development of heat transfer elements for transferring heat with a small temperature difference over a long distance. Of these elements, elements for actively transferring heat by using the movement of a fluid flowing through a heat pipe, a dream pipe, or the like are especially expected to be developed. Of these elements, especially a cryogenic loop heat pipe having a loop capillary tube has advantages. For example, this pipe has good operability because it requires no special fluid driving source, and also exhibits a high degree of freedom in installation because it can have a flexible structure as a whole.

The structure of the cryogenic loop heat pipe will be briefly described below.

The cryogenic heat pipe is formed by sealing a working fluid into a capillary tube consisting of copper and shaped into a loop.

When the loop capillary tube is to be actually used as the heat pipe, a portion of the tube is thermally connected, as a heat absorbing portion, to an object to be cooled, and the other end of the capillary tube is thermally connected, as a heat dissipating portion, to a heat absorption object, e.g., a cooling source. In many cases, these portions are connected by using blocks or the like consisting of a good heat conduction material.

When the working fluid in the heat absorbing area is heated by heat entering the heat absorbing portion, a vapor bubble is generated in the working fluid. This vapor bubble displaces the liquid around the bubble. Although this displacement force acts toward the two sides of the loop with the heat absorbing portion serving as a boundary, the force in one direction can be made stronger by, for example, finely unbalancing the arrangement. As a result, the flow component of the liquid in one direction increases, and the working fluid circulates or oscillates in the loop. This movement of the working fluid contributes to heat exchange between the heat absorbing portion and the heat dissipating portion, thus performing heat transfer. Since the latent heat of evaporation is absorbed when the fluid is evaporated at the heat absorbing portion and releases it when gas condenses at the heat dissipating portion, at a small temperature difference, a large amount of heat can be transferred in particular. For this reason, heat can be transferred in an amount 10 to 100 times that transferred by using a copper member, as a heat transfer element, which has the same cross-sectional area as that of the capillary tube.

Although the cryogenic loop heat pipe has such advantageous characteristics, the pipe does not operate if the dimensions of the capillary tube fall outside the operating conditions. For this reason, a cryogenic loop heat pipe must be designed after a sufficient examination. For example, the inner diameter of the capillary tube is empirically determined by trial and error. In addition, when the operating temperature range is determined, the type of operating fluid that is suited for this temperature range must be used. However, since optimal capillary tube inner diameter varies from one working fluid to the other, the same trial-and-error testing must be repeated.

As described above, in order to design a cryogenic heat pipe, a test must be performed under each operating condition. Currently, this problem interferes with the applications of the cryogenic loop heat pipe.

BRIEF SUMMARY OF THE INVENTION

As described above, conventionally, in order to determine the inner diameter of a capillary heat pipe, each heat pipe must be independently tested for optimization in accordance with the operating conditions such as the temperature and working fluid, resulting in poor applicability.

It is, therefore, an object of the present invention to provide a cryogenic heat pipe capable of transporting optimal heat in accordance with the operating conditions under consideration.

In order to achieve the above object, according to the first means of the present invention, there is provided a cryogenic heat pipe comprising a sealed tube in which a working fluid circulates and which has a portion used as a heat absorbing portion and a portion, other than the heat absorbing portion, that is used as a heat dissipating portion, the tube being formed to satisfy $\mathbf{15}d<l<\mathbf{882}d$ where l is a heat exchange length of the tube at the heat absorbing portion, and d is an inner diameter of the tube at the heat absorbing portion.

In this cryogenic heat pipe, the inner diameter d of the tube preferably satisfies $L<d<3L$ where $\sigma$ is the surface tension of the working fluid, $\rho_1$ is the density of the working fluid in the liquid phase, $\rho_v$ is the density of the working fluid in the gas phase, g is the gravitational acceleration, and L is the Laplace constant given by $L=[\sigma/\{(\rho_1-\rho_v)g\}]^{0.5}$.

According to this arrangement, the working fluid is driven by a vapor bubble generated in the tube at the heat absorbing portion, and moves in the tube while performing heat exchange at the heat dissipating and absorbing portions. By setting the heat transfer area of the heat absorbing portion to be larger than the minimum area with which the heat pipe properly operates, the cryogenic heat pipe can be properly operated. In addition, by setting a proper inner diameter, a cryogenic heat pipe having a high heat transport capacity can be obtained. As the working fluid of heat pipe, a fluid selected from helium, hydrogen, neon, nitrogen, oxygen, argon, and mixtures thereof can be used.

According to second means of the present invention, there is provided a cryogenic heat pipe comprising a sealed tube in which a working fluid circulates and which has a portion used as a heat absorbing portion and a portion, other than the heat absorbing portion, that is used as a heat dissipating portion, the working fluid being one member selected from the group consisting of helium, hydrogen, neon, and mixtures thereof, and the tube being formed such that the inner diameter d at the heat absorbing portion satisfies $L<d<3L$ where $\sigma$ is a surface tension of the working fluid, $\rho_1$ is a density of the working fluid in the liquid phase, $\rho_v$ is a density of the working fluid in the gas phase, g is a gravitational acceleration, and L is a Laplace constant given by $L=[\sigma/\{(\rho_1-\rho_v)g\}]^{0.5}$.

In addition, when the heat exchange length of the heat absorbing portion of the tube is represented by l, and the inner diameter of the tube at the heat absorbing portion is represented by d, l and d preferably satisfy $15d<l<882d$.

According to this arrangement, by setting a proper inner diameter, a cryogenic heat pipe having a high heat transport capacity can be obtained. Since the heat transfer area of the heat absorbing portion can be set to be larger than the minimum area with which the heat pipe properly operates, the cryogenic heat pipe can be properly operated.

In the first and second means, the tube preferably has the heat absorbing and dissipating portions alternately arranged in the axial direction of the tube.

In this case, the heat absorbing and dissipating portions may respectively include a plurality of heat absorbing portions and a plurality of heat dissipating portions.

In the first and second means, the heat dissipating portion is preferably located at a level higher than that of the heat absorbing portion.

According to this arrangement, since the buoyancy of a vapor bubble in the tube is added to the driving force for the working fluid, a high heat transport capacity can be expected.

In addition, the tube at the heat absorbing portion is preferably inclined at a predetermined angle or more with respect to the horizontal plane. It is more preferable that the tube at the heat absorbing portion is oriented almost in vertical direction.

With this arrangement as well, since the buoyancy of a vapor bubble generated in the tube at the heat absorbing portion is added to the driving force for the working fluid, a high heat transport capacity can be obtained.

Furthermore, if the tube is partly partitioned with respect to the flow direction of the working fluid so as to form a double tube portion forming outgoing and incoming paths, a proper operation can be performed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiments of the present invention will be described below with reference to FIGS. 1 to 17.

The first embodiment of the present invention will be described first with reference to FIGS. 1 to 12.

Figure 1:
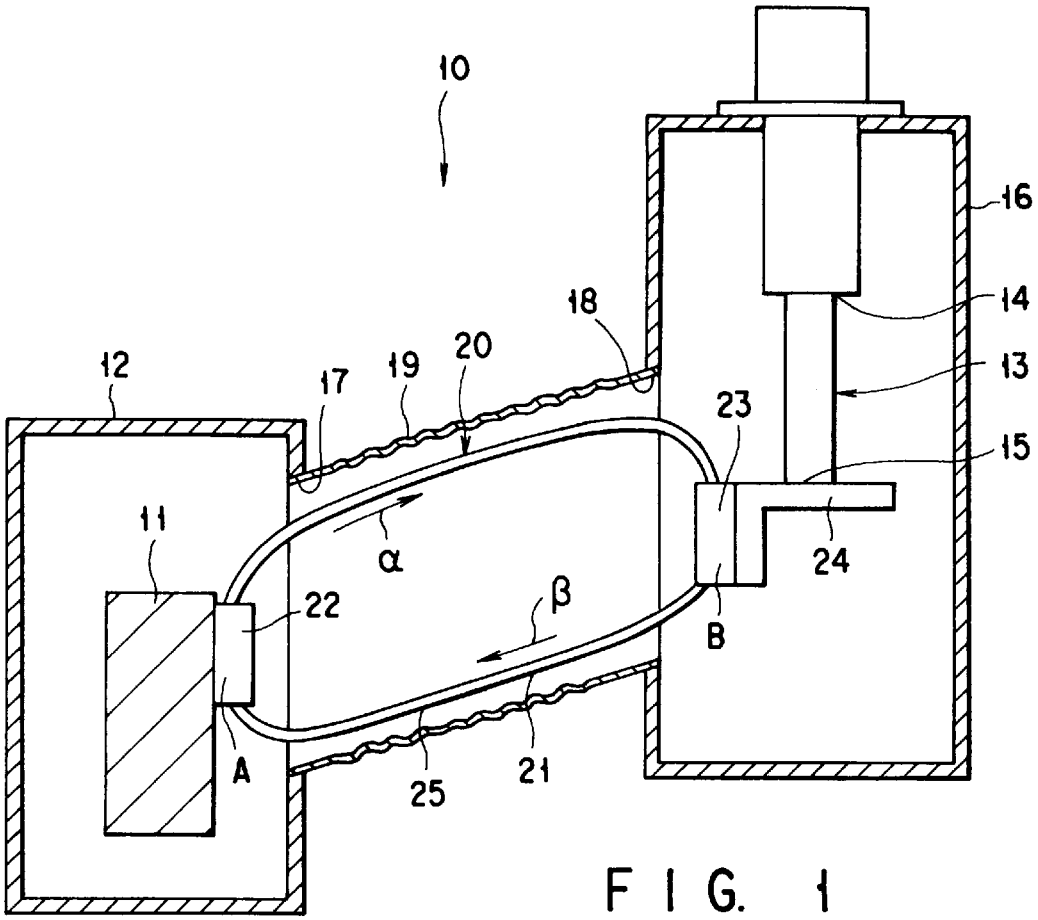
FIG. 1 is a sectional view showing a cooling apparatus incorporating a cryogenic heat pipe according to the first embodiment of the present invention.

FIG. 1 shows a cooling apparatus 10 incorporating a cryogenic loop heat pipe according to the first embodiment of the present invention.

Referring to FIG. 1, reference numeral 11 denotes an object to be cooled to, for example, the liquid nitrogen temperature level. The object 11 is placed in a vacuum vessel 12 serving as a thermal insulator.

Referring to FIG. 1, reference numeral 13 denotes a refrigerator. For example, the refrigerator 13 is constituted by a Gifford-McMahon refrigerator. The refrigerator 13 comprises a first cooling stage 14 and a second cooling stage 15 which is cooled to a temperature lower than that of the first cooling stage 14 and slightly lower than the liquid nitrogen temperature level. The first and second cooling stages 14 and 15 are arranged in a vacuum vessel 16 serving as a thermal insulator.

Communicating ports 17 and 18 are respectively formed in side walls of the vacuum containers 12 and 16. These communicating ports 17 and 18 are hermetically connected to each other through a flexible connection pipe, specifically a bellows connection pipe 19, which suppresses transfer of vibrations from the vacuum vessel 16 side to the vacuum vessel 12 side. The object 11 is thermally connected to the second cooling stage 15 of the refrigerator 13 through a cryogenic loop heat pipe 21 extending through the connection pipe 19.

This cryogenic loop heat pipe 21 has a close loop capillary tube 25 which is, for example, a flexible thin copper tube having portion A (to be referred to as the heat absorbing portion A hereinafter) and portion B (to be referred to as the heat dissipating portion B) in the loop, the two ends of the capillary tube being joined together to form a close loop. A working fluid (nitrogen ($N_2$) in this case) serving as a heat transport medium is sealed into the loop capillary tube 25.

A heat conduction member 22 consisting of a copper block or the like and used to thermally connect a portion of the cryogenic loop heat pipe 21 to the object 11 is provided at the heat absorbing portion A. Similarly, heat conduction members 23 and 24 consisting of copper blocks or the like and used to thermally connect a portion of the cryogenic loop heat pipe 21 the heat absorbing portion A, to the second cooling stage 15 of the refrigerator 13 are provided at the heat dissipating portion B.

Figure 2:
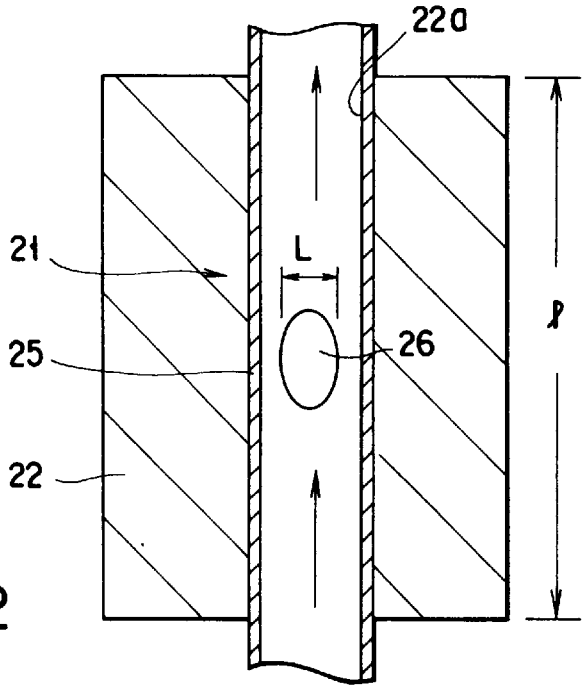
FIG. 2 is a sectional view for explaining the meaning of the Laplace constant.

At the heat absorbing portion A which is one of the heat transfer points in the loop, the capillary tube 25 vertically extends through a hole 22*a* formed in the heat conduction member 22 and is brazed thereto, as shown in FIG. 2. Similarly, at the heat dissipating portion B which is the other heat transfer point, the capillary tube 25 extends through a hole (not shown) formed in the heat conduction member 23 and is brazed thereto.

In this case, the loop capillary tube 25 consists of a copper tube having an inner diameter d that satisfies the condition, $$L<d<3L \quad (1)$$

provided that the surface tension of the working fluid is represented by $\sigma$; the density of the working fluid in the liquid phase (the density of the liquid phase), $\rho_1$; the density of the working fluid in the vapor phase (the density of the gas phase), $\rho_v$; and the gravitational acceleration, g, and Laplace constant L is given by $L=[\sigma/\{(\rho_1-\rho_v)g\}]^{0.5}$.

In this case, the Laplace constant L corresponds to the diameter of a vapor bubble 26 detached from the inner surface (heat transfer surface) of the loop capillary tube 25, as shown in FIG. 2.

Note that the portions of the loop capillary tube 25 which correspond to the heat absorbing portion A and the heat dissipating portion B must consist of a material having a high heat conductivity (good heat conduction material), e.g., a metal such as copper. However, the remaining portions need not consist of a metal, and may consist of a resin or the like because no heat exchange is required.

Figure 3:
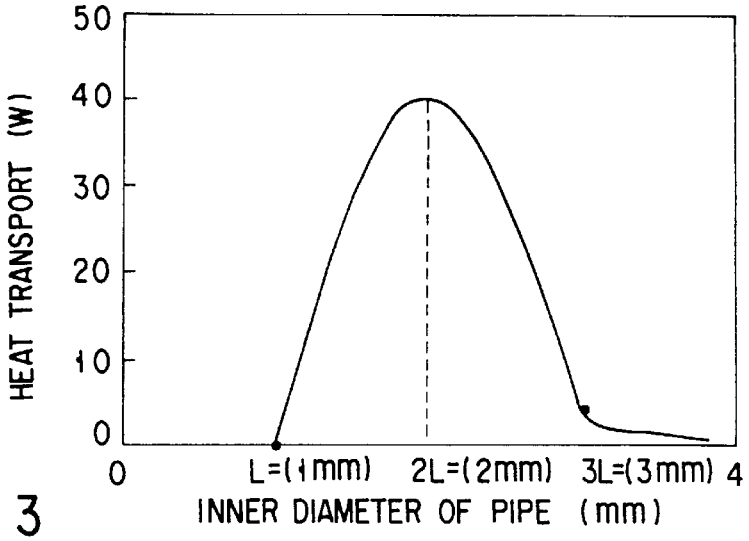
FIG. 3 is a graph showing the relationship between the inner diameter of a loop capillary tube and the heat transport when nitrogen is used as a working fluid.

FIG. 3 shows the results of an experiment aimed at checking the relationship between the diameter d of the loop capillary tube 25 and the heat transport. As is apparent from this graph, when the diameter d exceeds the Laplace constant L, heat transport by the heat pipe takes place. When d (diameter)=2L, the maximum heat transport is obtained. When the diameter d is equal to or larger than 3L, the heat transport effect is very weak. As is apparent, therefore, a good heat transport effect can be obtained when the condition (1) is satisfied.

In this embodiment, since nitrogen is used as the working fluid, the diameter of a vapor bubble 26 detached from the inner surface (heat transfer surface) of the loop capillary tube 25, i.e., the Laplace constant L, is given by L=1 (mm). According to the condition (1) and FIG. 3, therefore, the inner diameter d of the loop capillary tube 25 is preferably set within the range of 1 mm to 3 mm, especially 2 mm.

The heat transport effect can not be determined solely by the inner diameter d of the loop capillary tube 25. In order to properly generate a vapor bubble 26 serving to generate a driving force in the loop capillary tube 25, the heat transfer area of the heat absorbing portion A (the inner area of the loop capillary tube 25 at the heat absorbing portion A) must be set to a predetermined value.

Figure 4:
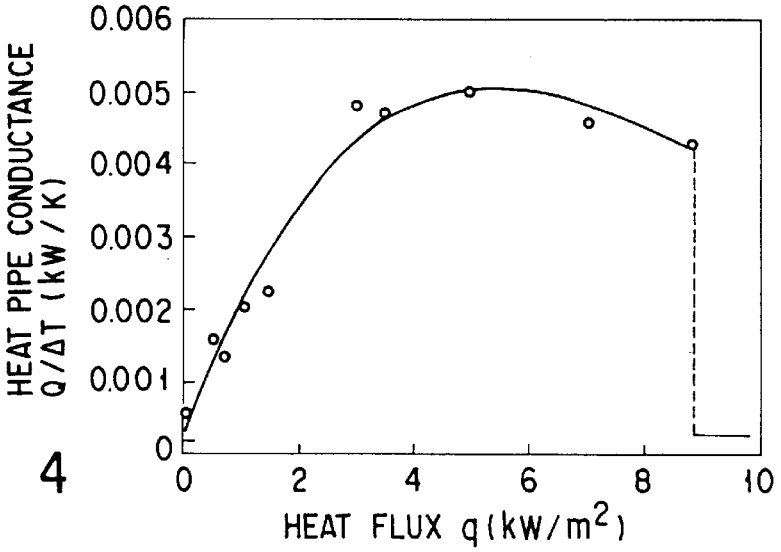
FIG. 4 is a graph showing the relationship between the heat flux and the conductance at a heat transfer surface.

FIG. 4 shows the results obtained by checking changes in conductance $Q/\Delta T$ with changes in heat flux q at the heat absorbing portion A. In this case, the conductance represents the total heat exchanged (Q) between the heat conduction member 22 and the working fluid per unit temperature change ($\Delta T$) in the temperature difference between the block 22 and block 23.

The heat flux q represents the heat transfer amount per unit time and unit heat transfer area. The heat flux q therefore increases as the inner circumferential surface area, i.e., the heat transfer area, of the loop capillary tube 25 at the heat absorbing portion A decreases while the total heat transfer amount is kept constant. In other words, the heat flux q increases as either the inner diameter d or the heat conduction length l of the capillary tube 25 is decreased or the both are decreased.

FIG. 4 can be thought of as showing changes in the conductance as the heat flux q is changed by decreasing the heat transfer area of the loop capillary tube 25 while the total amount of heat transfer is kept constant.

FIG. 4 shows that as the heat flux q is increased by decreasing the heat transfer area, the conductance gradually increases. This indicates that the working fluid in the loop capillary tube 25 is effective in transporting heat. The heated working fluid boils in nucleate boiling to form the vapor bubble 26 near the inner surface of the loop capillary tube 25. The vapor bubble 26 supplies the driving force required for heat transport by way of liquid/vapor movement as shown in FIG. 2.

In contrast to this, as shown in FIG. 4, when the heat flux q exceeds about 9 ($kW/m^2$), the heat conductance decreases abruptly. This indicates that minute vapor bubbles generated between the vapor bubble 26 and the inner surface of the loop capillary tube 25 join each other to cause film boiling or to disintegrate bubbles such as vapor bubble 26. The working fluid then cannot be heated anymore without the rise of temperature of heat conduction member 2. In this state, proper vapor bubbles cannot be formed, and hence heat transport becomes drastically weak.

As described above, the heat transfer area greatly influences the heat transport of the heat pipe. The relationship between the heat transfer area and the heat transport will be examined.

According to Cryogenics, "Heat Transfer During Liquid Nitrogen Cooling of High Temperature Superconductors", 1991, Vol. 31, P. 979, limiting heat flux qmax in natural convection in a capillary tube is given by equation (2):

$$q_{\max} = \frac{0.0995\, h_{fg}\rho_v[\sigma g(\rho_l - \rho_v)]^{0.25}\left(\frac{\rho_l}{\rho_v}\right)^{0.0638}}{1 + 3.97\times 10^{-3}(l/d)^{1.44}} \tag{2}$$

where $q_{max}$ is the limiting heat flux per capillary tube, d is the inner diameter of the capillary tube 25, and l is the length (heat transfer length) of the capillary tube 25 at the heat absorbing portion A.

A heat transfer area S is given by $S=\pi dl$.

Since the numerator of equation (2) is not dependent on the heat transfer area, it can be substituted by a constant a, and equation (2) can be rewritten as in equation (3):

$$q_{\max} = \frac{a}{1 + 3.97\times 10^{-3}(l/d)^{1.44}} \tag{3}$$

Since the maximum heat transfer $Q_{max}$ per capillary tube is given by $Q_{max}=S\cdot q_{max}$, it can be expressed as in equation (4):

$$\begin{aligned} Q_{\max} &= S\cdot q_{\max} \\ &= \pi dl\cdot q_{\max} \\ &= \frac{a\pi dl}{1 + 3.97\times 10^{-3}(l/d)^{1.44}} \end{aligned} \tag{4}$$

Equation (4) represents the maximum heat transfer $Q_{max}$, as a function of the inner diameter d, and the heat transfer length l.

To determine the peak of $Q_{max}$, equation (4) is once differentiated, and letting the resultant value to be 0 as in equation (5), we can obtain a value for l as $l_{peak}$, for which the $Q_{max}$ is maximized.

$$\begin{aligned} \frac{dQ_{\max}}{dl} &= \frac{\pi da[\{1 + 3.97\times 10^{-3}(l/d)^{1.44}\} - 3.97\times 10^{-3}\times 1.44\times (l/d)^{1.44}]}{\{1 + 3.97\times 10^{-3}(l/d)^{1.44}\}^2} = 0 \\ & 1 + 3.97\times 10^{-3}(l/d)^{1.44} - 3.97\times 10^{-3}\times 1.44(l/d)^{1.44} = 0 \end{aligned} \tag{5}$$

By numerically solving equation (5), it can be shown that:

$$l_{peak}=82.245d \tag{6}$$

The peak maximum heat transfer is then obtained by substituting $l_{peak}$ in l of equation (4) s follows:

$$Q_{peak}=25.130\pi ad^2 \tag{7}$$

Figure 5:
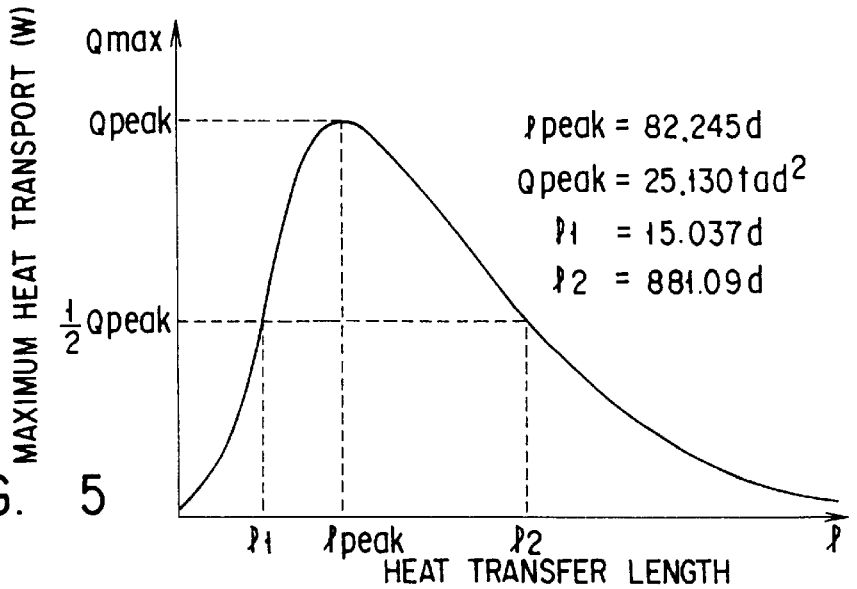
FIG. 5 is a graph showing the relationship between the maximum heat transport and the heat transfer length.

FIG. 5 is a graph representing equation (4), with the maximum heat transfer $Q_{max}$ being plotted along the ordinate, and the heat transfer length l being plotted along the abscissa.

If preferable amount of heat transfer per capillary tube is to be set to ½ or more of the maximum heat transfer $Q_{peak}$, design heat transfer length l should fall between $l_1$ and $l_2$ as shown in FIG. 5. In order to calculate $l_1$ and $l_2$, value of $(½)Q_{peak}$ is substituted in equation (4) for $Q_{max}$ and the resulting equation solved for l.

$$Q_{\max} = \frac{Q_{peak}}{2} = \frac{25.13\,\pi ad^2}{2} = \frac{a\pi dl}{1 + 3.97\times 10^{-3}(l/d)^{1.44}}$$

solving the above numerically, $$l_1=15.037d \tag{8}$$

$$l_2=881.09d \tag{9}$$

Therefore, in order to obtain a preferable heat transfer effect, the suitable heat transfer area may be determined by selecting the inner diameter d according to equation (1) and heat transfer length l of the capillary tube 25 at the heat absorbing portion A according to equation (10):

$$15.04d<l<881.09d \tag{10}$$

Equation (10) is redefined with round-numbers as follows:

$$15d<l<882d \tag{10}$$

In this case, the inner diameter d needs to satisfy equation (1): and more preferably, d=2L. When nitrogen is used for instance 1 (mm)<d<3 (mm) and more preferably d=2 mm.

Figure 6A:
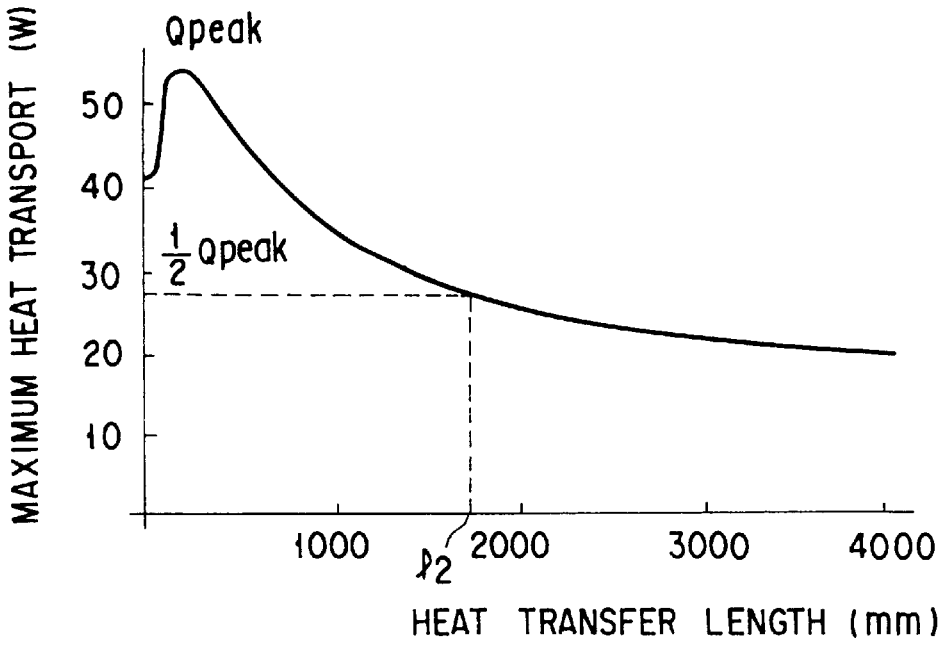
FIG. 6A is a graph showing the relationship between the maximum heat transport and the heat transfer length when nitrogen is used as a working fluid.
Figure 6B:
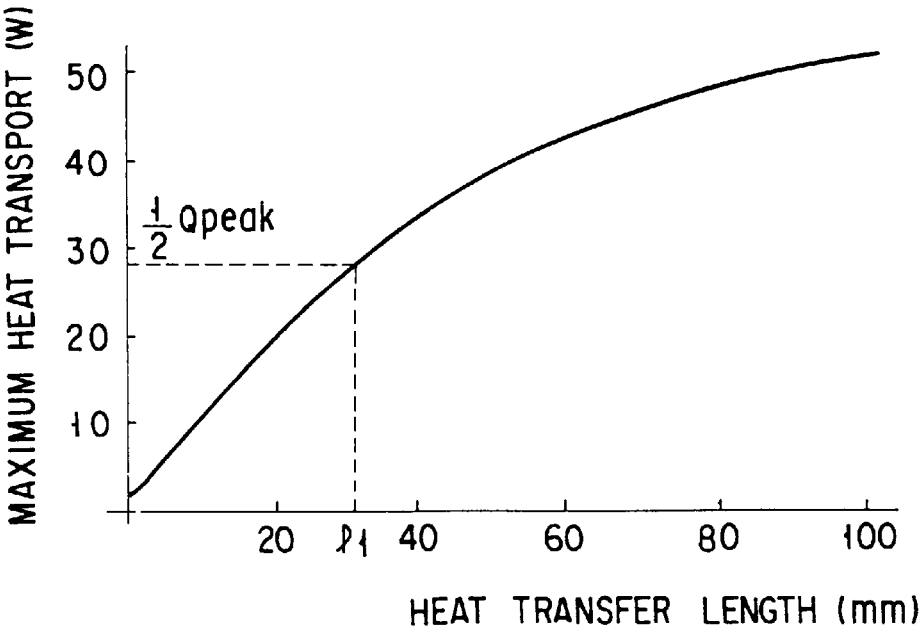
FIG. 6B is a graph showing an enlarged view of a portion of the graph in FIG. 6A.

FIGS. 6A and 6B show the results obtained by calculating $Q_{max}$ of equation (4) when nitrogen is used as the working fluid and the inner diameter d of the capillary tube 25 is set to 2 mm. According to these FIGS., as the preferable heat transfer lengths l, should be between 31.08 mm to 1762.18.

In the cooling apparatus having the above arrangement, when the refrigerator 13 is started, heat of the object 11 is absorbed by the refrigerator 13 through a cryogenic loop heat pipe apparatus 20. More specifically, heat of the object 11 is transferred to the heat conduction member 22. The heat is then transferred from the heat conduction member 22 to the working fluid in the capillary tube 25 at the heat absorbing portion A through the tube wall of the capillary tube 25 which serves as a heat transfer surface.

As a result, of the heat transfer vapor bubble 26 is generated in the capillary tube 25 at the heat absorbing portion A, and a circulating or oscillatory flow of working fluid (arrow α) is generated in the cryogenic loop heat pipe 21 by the liquid displacement force and buoyancy of the vapor bubble. The vapor bubble 26 is then carried to the heat dissipating portion B by this circulating or oscillatory flow.

The tube wall of the capillary tube 25 at the heat dissipating portion B has been cooled to the condensation temperature level of the working fluid or lower. For this reason, the vapor bubble 26 which has reached the heat dissipating portion B condenses releasing latent heat of condensation. Heat of the object 11 is therefore absorbed by the refrigerator 13 through the cryogenic loop heat pipe apparatus 20. That is, the heat absorbing portion A of the cryogenic loop heat pipe 21 serves to absorb heat from the object 11, and the heat dissipating portion B serves to dissipate the absorbed heat to the refrigerator 13. With these two functions, the object 11 is cooled to the condensation temperature level or lower. That is, the cooling apparatus shows its ability to perform cooling function.

According to the arrangement of the first embodiment, since the direction (shown by arrow β) in which the working fluid liquefied at the heat dissipating portion B descends owing to the gravity can be made to coincide with the direction (arrow α) in which the vapor bubble 26 generated at the heat absorbing portion A ascends owing to the buoyancy, the circulating force of the working fluid can be increased, thereby further increasing the heat transport from A to B.

Furthermore, in this case, since the capillary tube 25 has the inner diameter d given by the condition (1) and the heat transfer length .h given by condition (10), the circulating force to be applied to the working fluid in the capillary tube 25 can be optimized. A large heat transport can therefore be obtained.

Note that condition (1) and (10) can be applied to cases wherein water, argon, oxygen, neon, hydrogen, helium, and mixtures thereof are used as working fluids, as well as the case wherein nitrogen is used as the working fluid.

Figure 7:
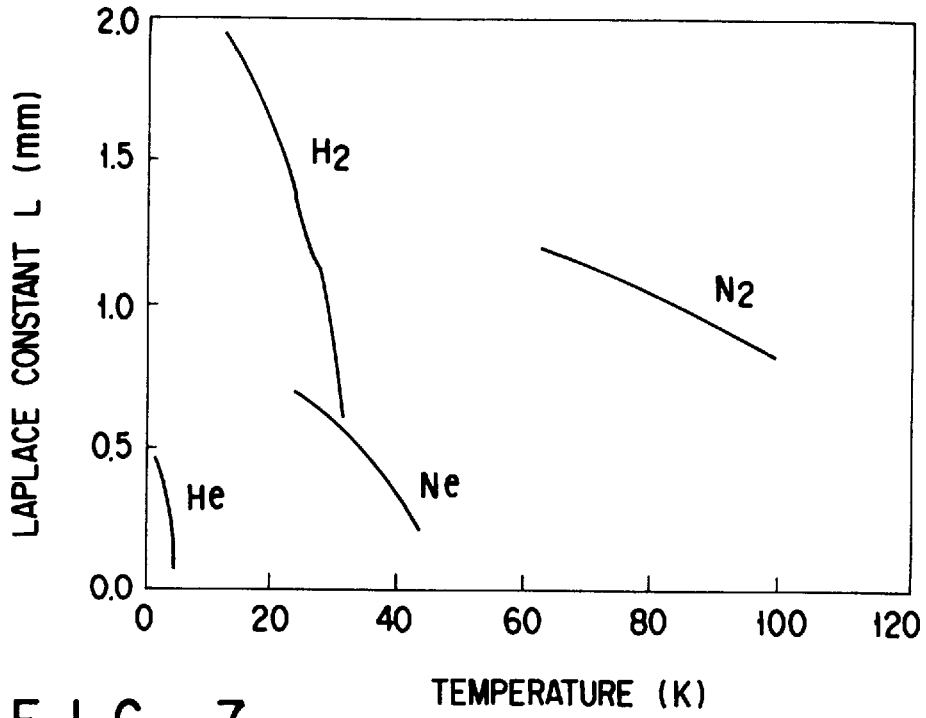
FIG. 7 is a graph showing the relationship between the temperature of each working fluid and the Laplace constant.
Figure 8:
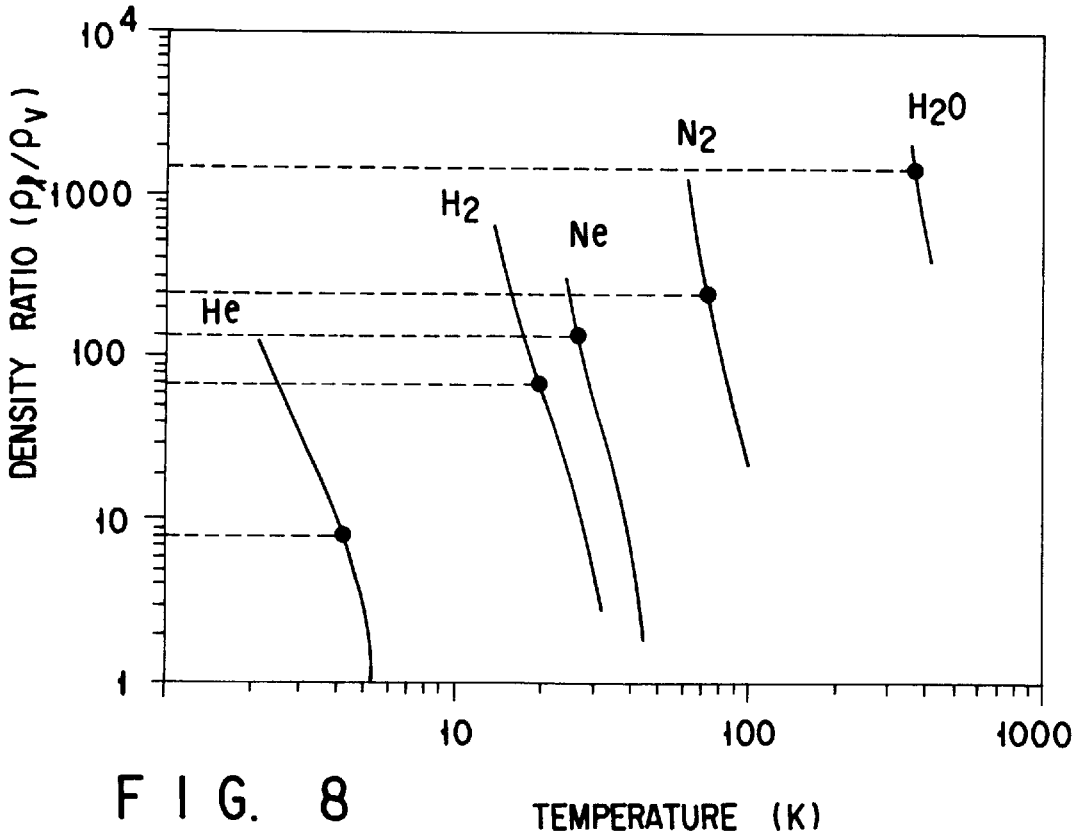
FIG. 8 is a graph showing the relationship between the temperature of each working fluid and the density ratio (the ratio of the density of liquid phase to the density of vapor phase)

Of the above working fluids, helium, hydrogen, neon, and nitrogen are particularly significant in the cryogenic engineering for superconductors, and their Laplace constants are shown in FIG. 7 as functions of temperature. Referring to FIG. 8, the abscissa represents the temperature, and the ordinate represents he ratio of the density $\rho_1$ of each working fluid in the liquid phase to the density $\rho_v$ of the working fluid in the vapor phase.

Figure 9A:
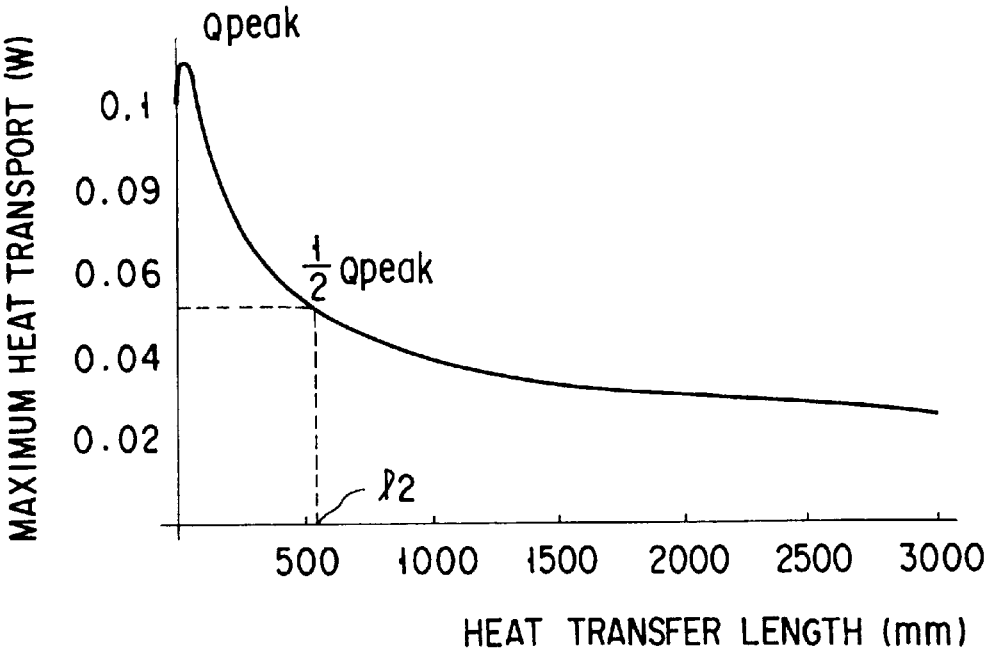
FIG. 9A is a graph showing the relationship between the maximum heat transport and the heat transfer length when helium is used as a working fluid.
Figure 9B:
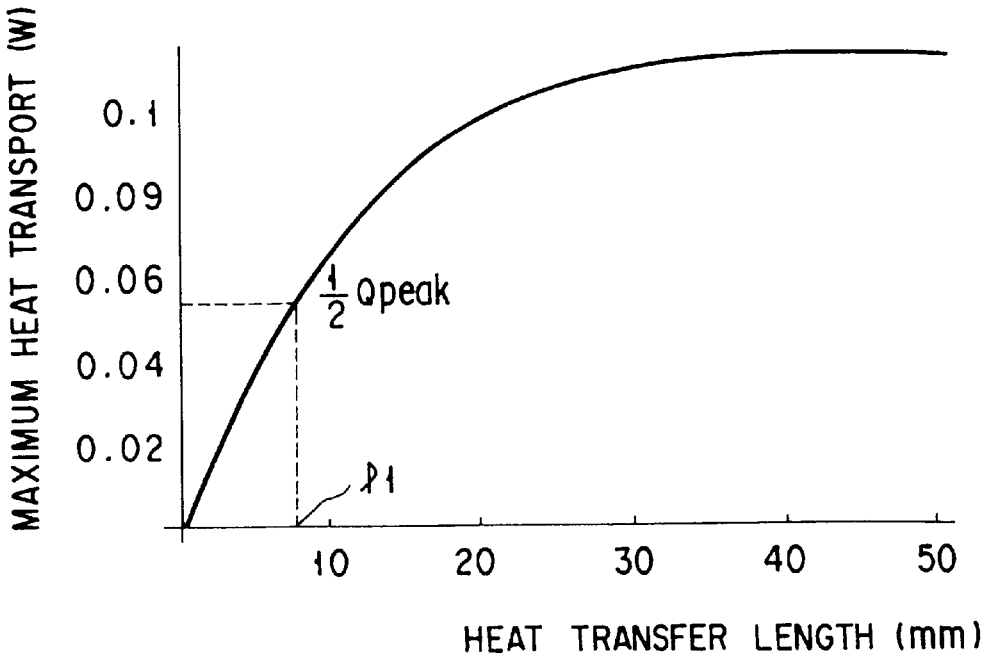
FIG. 9B is a graph showing an enlarged view of a portion of the graph in FIG. 9A.

When, for example, helium (He) is used as the working fluid, since its boiling point is 4.2 (k) and Laplace constant L=0.31 at that temperature, upper and lower limits of the heat transfer area of the heat absorbing portion A is obtained by setting inner diameter d of the capillary tube 25 to the preferable diameter, d=2L=0.62 mm. FIGS. 9A and 9B show the relationship between the maximum heat transport $Q_{max}$ and the heat transfer length l when helium is used. In order to obtain ½ or more the maximum heat transport $Q_{peak}$ as preferable heat transport, d is set to 0.62 (mm) according to condition (10), and the heat transfer length l of the capillary tube 25 may be designed within the following range:

$$9.32(\text{mm})<l<546.28(\text{mm})$$

Figure 10A:
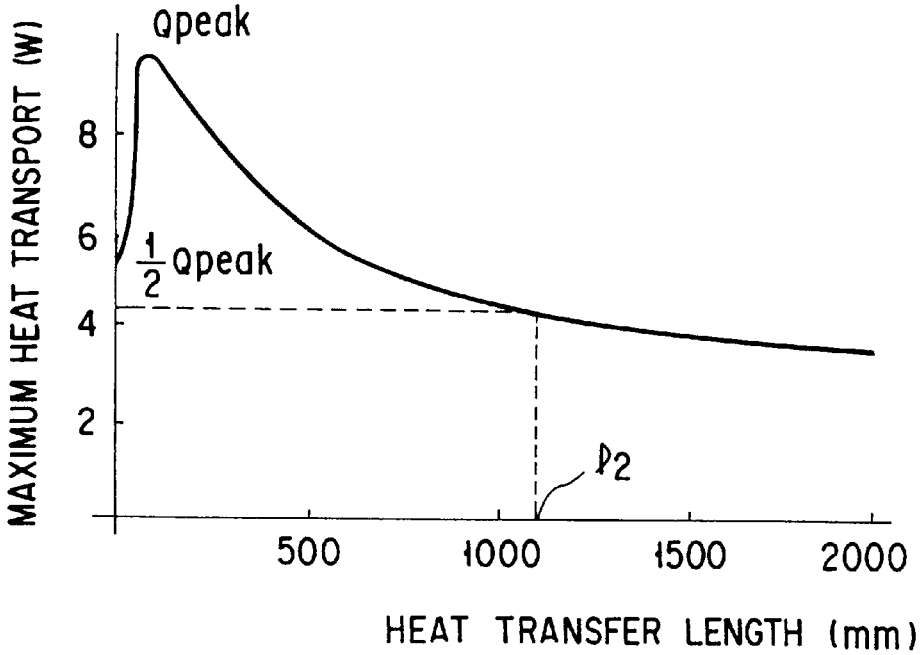
FIG. 10A is a graph showing the relationship between the maximum heat transport and the heat transfer length when neon is used as a working fluid.
Figure 10B:
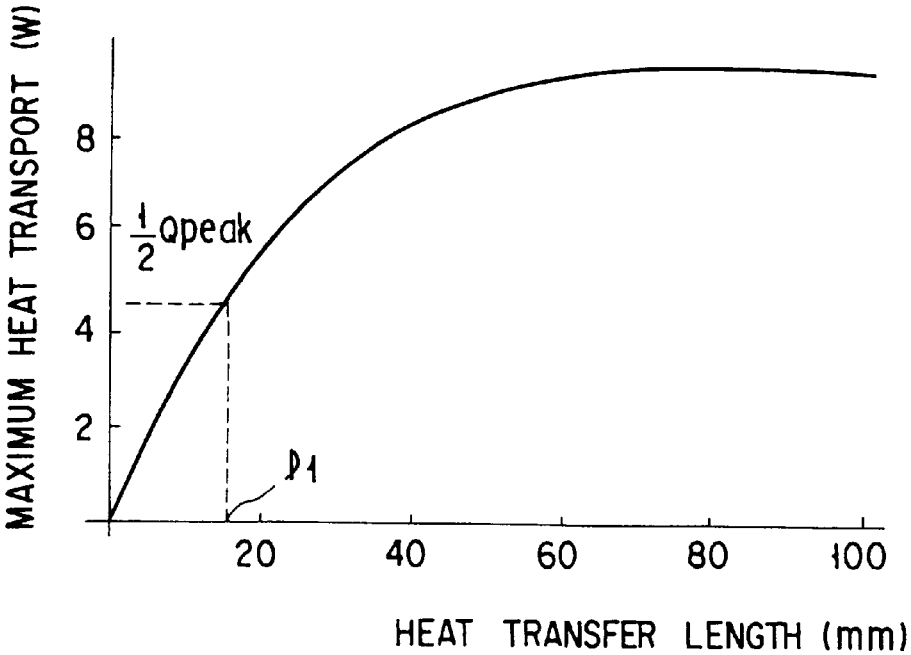
FIG. 10B is a graph showing an enlarged view of a portion of the graph in FIG. 10A.

When neon (Ne) is used as a working fluid, since its boiling point is 27.1 (k) and Laplace constant L=0.63 at that temperature, upper and lower limits of the heat transfer area of the heat absorbing portion A is obtained by setting the inner diameter d of the capillary tube 25 to the preferable diameter, d=2L=1.62 mm. FIGS. 10A and 10B show the relationship between the maximum heat transport $Q_{max}$ and the heat transfer length l when neon is used. In order to obtain ½ or more the maximum heat transport $Q_{peak}$ as preferable heat transport, d is set to 1.26 (mm) according to condition (10), and the heat transfer length l of the capillary tube 25 may be designed within the following range:

$$18.95(\text{mm})<l<1110.17(\text{mm})$$

Figure 11A:
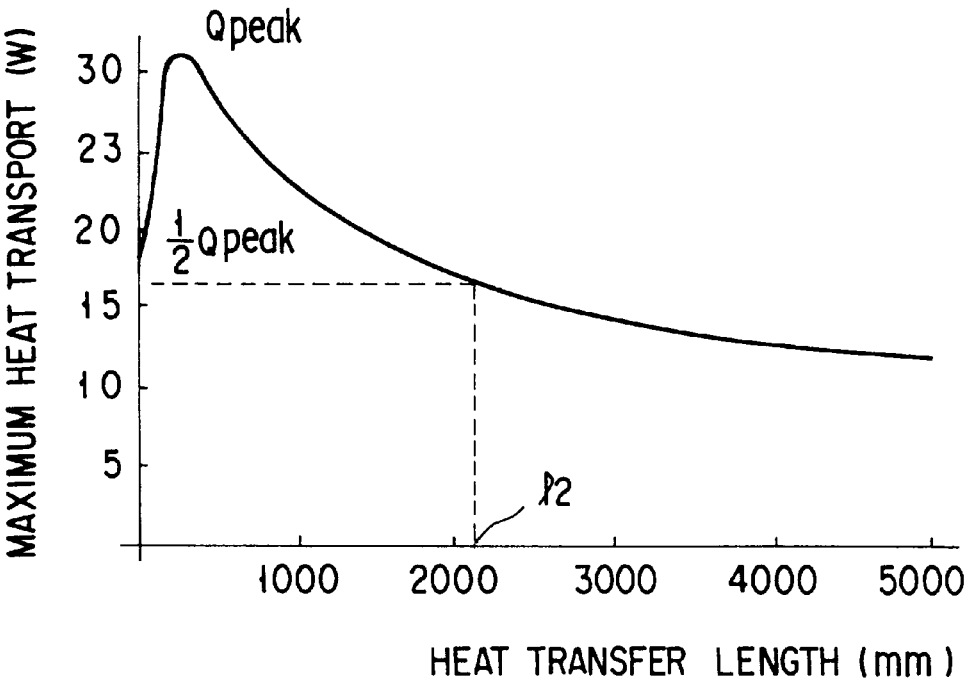
FIG. 11A is a graph showing the relationship between the maximum heat transport and the heat transfer length when hydrogen is used as a working fluid.
Figure 11B:
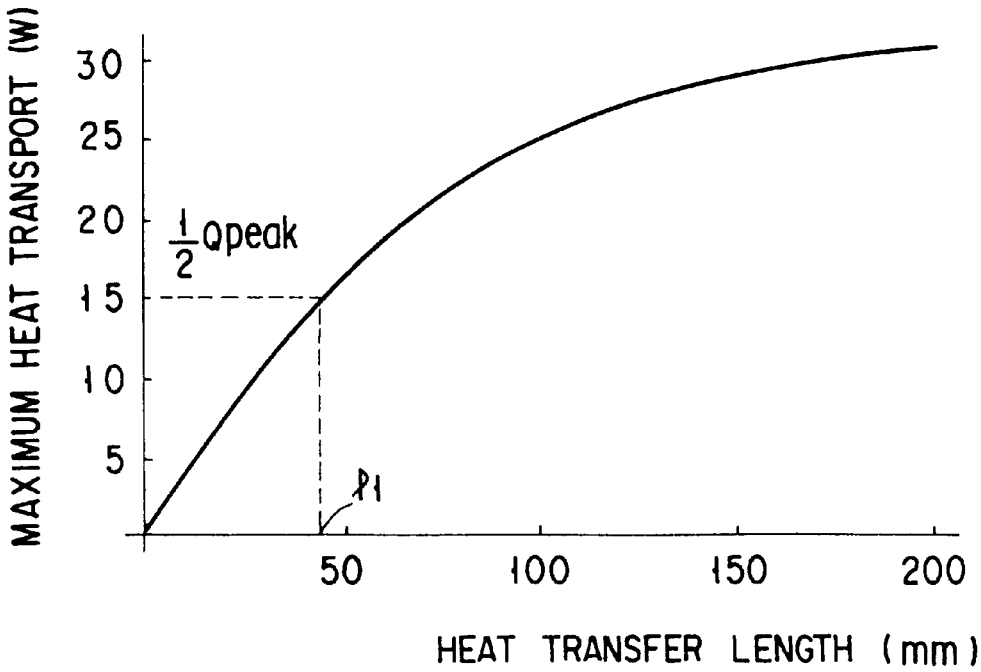
FIG. 11B is a graph showing an enlarged view of a portion of the graph in FIG. 11A.

When hydrogen is used as a working fluid, since its boiling point is 20.3 (k) and Laplace constant L=1.66 at that temperature, upper and lower limits of the heat transfer area of the heat absorbing portion A is obtained by setting the inner diameter d of the capillary tube 25 to the preferable diameter, d=2L=2.32 mm. FIGS. 11A and 11B show the relationship between the maximum heat transport $Q_{max}$ and the heat transfer length l when hydrogen is used. In order to obtain ½ or more the maximum heat transport $Q_{peak}$ as preferable heat transport, d is set to 2.32(mm) according to condition (10), and the heat transfer length l of the capillary tube 25 may be designed within the following range:

$$34.89(\text{mm})<l<2044.13(\text{mm})$$

In this embodiment, ½ or more of the peak maximum heat transport $Q_{peak}$ is regarded as the preferable heat transport, and condition (10) is used. More preferably, ⅔ or more of the maximum heat transport $Q_{peak}$ may be regarded as the preferable heat transport, and condition (11) may be used. More preferably, ¾ or more of the maximum heat transport $Q_{peak}$ may be regarded as a preferable heat transfer amount, and inequality (12) may be used. More preferably, the rated heat transport may be set equal to the maximum heat transport $Q_{peak}$, and condition (13) may be used.

$$22.72d<l<432.79d \quad (11)$$

$$27.85d<l<314.81d \quad (12)$$

$$l=82.24d \quad (13)$$

In the case shown in FIG. 1, a one-turn type cryogenic loop heat pipe 21 is used. However, the present invention is not limited to this structure. A plurality of 1-turn type loop heat pipes 21 are preferably used. Alternatively, a coil-like cryogenic loop heat pipe obtained by winding a single capillary tube in multiple turns can be used.

With this structure, the capillary tube 25 is passed through the heat conduction member 22 a number of times (n times). In this case, the maximum heat transport of this heat pipe is given by $n \cdot Q_{max}$, and hence the heat transport capacity increases.

In the above embodiment, since the capillary tube 25 extends vertically at the heat absorbing portion A, the working fluid is driven by the displacement force and buoyancy of the vapor bubble 26. If, however, the capillary tube 25 inclines with respect to the vertical direction at the heat absorbing portion A, the driving force based on the buoyancy of the vapor bubble 26 decreases. More specifically, letting θ be the inclination of the capillary tube 25 with respect to the horizontal plane at the heat absorbing portion A, the maximum heat transport $Q(\theta)_{max}$ at the θ inclination is given by $Q_{max} \cos \theta$.

Note that when the operating temperature boiling point of a working fluid is lower than that of nitrogen (whose boiling point is 77.3 (k) and Laplace constant is 1.05), a sufficient driving force may not be obtained if the inclination θ of the capillary tube 25 is too small. In this case, since the movement of the working fluid becomes slow, all the working fluid in the capillary tube 25 at the heat absorbing portion A may vaporize, resulting in a dry state. It has been confirmed that such a phenomenon indeed occurs when the inclination of the capillary tube 25 is set to 5° to 10° or less. When for example, either one of the cryogeus, hydrogen, neon, or helium is to be used as the working fluid, the inclination angle needs to be 5° or more.

Figure 12:
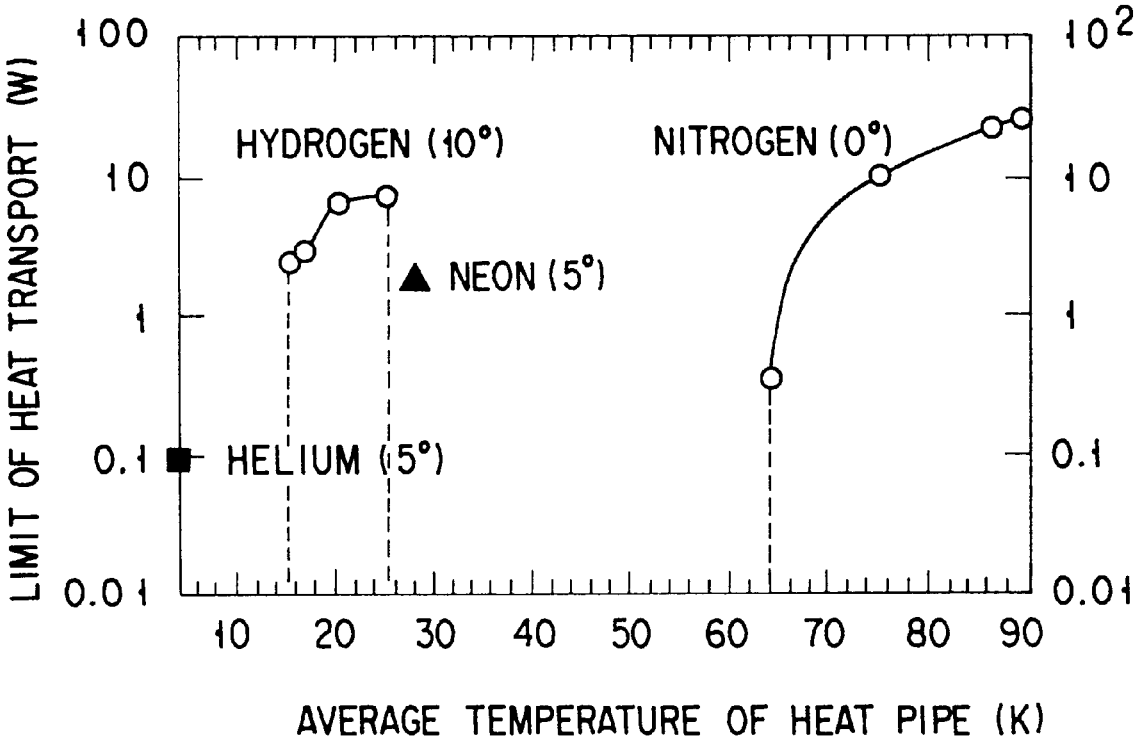
FIG. 12 is a graph showing the relationship between the maximum heat transport and the average heat pipe temperature for each working fluid and each inclination of the capillary tube.

FIG. 12 shows the relationship between the limit of heat transport (ordinate) and the average heat pipe temperature (abscissa) for the following working fluids and inclinations. For helium, the inclination angle is set to 5°; for hydrogen 10°; for neon 5°; and for nitrogen 0°. According to heat transport measurements conducted by the present inventor, a proper heat pipe operation is warranted within the inclination range of 5° to 90° with helium; 5° to 90° with hydrogen; 5° to 90° with neon; and 0° to 90° with nitrogen, having selected the proper heat pipe diameter.

According to the above arrangement, the following effects can be obtained.

The Laplace constant L corresponds to the diameter of a vapor bubble leaving the heat transfer surface in a liquid owing to the heat load, and is formulated by the above expressions for various liquids.

If the inner diameter of the loop capillary tube is L or less, no liquid is present between the vapor bubble and the inner wall. For this reason, vapor needed for the growth of the bubble is hard to generate, and therefore the force for driving the fluid in the capillary tube decreases. As a result, the heat transport abruptly decreases.

In contrast to this, if the inner diameter d of the loop capillary tube is 3L or more, the amount of liquid displaced upon movement of the vapor bubble decreases as a result of smaller area the vapor bubble occupies in the pipe cross-section. Therefore, the force for driving the fluid in the capillary tube decreases.

By setting the inner diameter d of the loop capillary tube according to $L<d<3L$, the loop driving force of driving the liquid in the loop capillary tube is optimized to greatly increase the heat transport.

As described above, the cryogenic loop heat pipe according to the present invention has been made with importance being attached to the size of a vapor bubble leaving the heat transfer surface. If air bubbles are generated in large quantities, they join each other to form a large vapor bubble. The bubble generation rate depends on the amount of heat transferred per unit area. As the amount of heat transferred per unit area increases, a larger number of vapor bubbles are generated. This phenomenon has been confirmed by experiment. This indicates the presence of the minimum heat transfer area with which the cryogenic loop heat pipe properly operates. Each of the heat transfer areas of the heat absorbing and dissipating portions needs to be larger than the minimum area with which the heat pipe properly operates, in consideration of the heat transfer amount given as a specification.

Note that if the level of the heat absorbing portion is set to a lower level than that of the heat dissipating portion in actually using this cryogenic loop heat pipe, the buoyancy of vapor bubble generated at the heat absorbing portion acts to support the loop driving force. Therefore, the heat transfer amount can be further increased.

Assume that this cryogenic loop heat pipe is incorporated in a system in which a plurality of heat absorption objects such as objects to be cooled are present independently and only one heat dissipating object such as a refrigerator is present, a system in which only one heat absorption object is present, and a plurality of heat dissipation objects are present independently, or a system in which a plurality of heat absorption objects are present independently, and a plurality of heat dissipation objects are present independently. In this case, if the heat absorbing and dissipating portions thermally connected to the heat absorbing and dissipating portions, respectively, appear alternately in the longitudinal direction of the tube while the loop capillary tube loops once, heat absorption and dissipation can be properly balanced, allowing stable heat transport.

Another embodiment of the present invention will be described next with reference to FIG. 13A and the subsequent drawings.

Figure 13A:
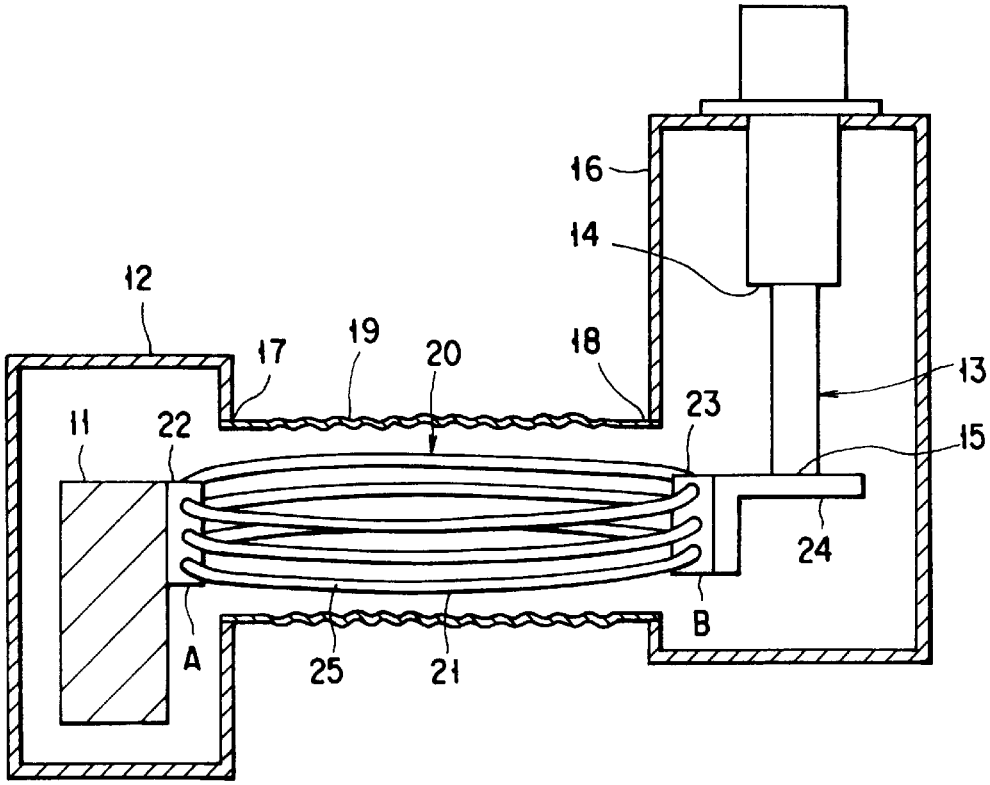
FIG. 13A is a sectional view showing the second embodiment of the present invention.
Figure 13B:
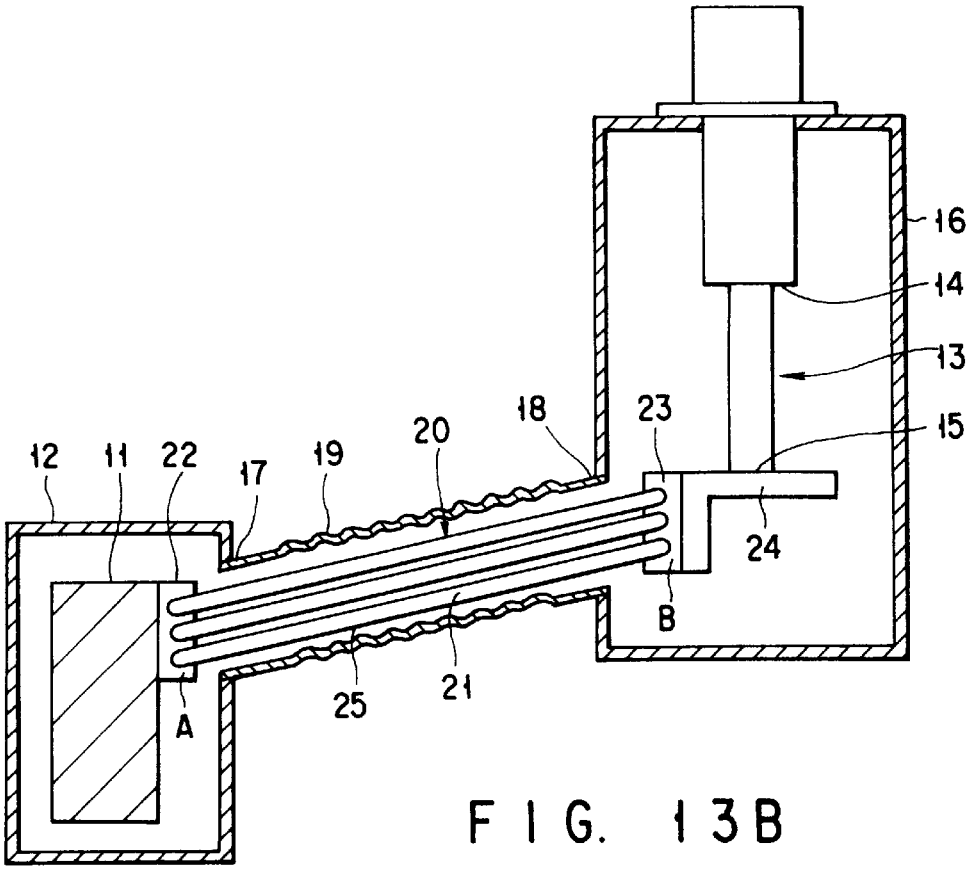
FIG. 13B is a sectional view showing a modification of the second embodiment.

FIGS. 13A and 13B show application examples of the cryogenic loop heat pipe of the present invention as the second embodiment. The same reference numerals in FIGS. 13A and 13B denote the same parts as in the first embodiment (FIG. 1), and hence a detailed repetitive description thereof will be omitted.

FIG. 13A shows a structure in which a plurality of one-turn type loop heat pipes 21, each obtained by forming the above capillary tube 25 into a loop within the horizontal plane, are arranged side by side in the vertical direction. In this case, a heat absorbing portion A and a heat dissipating portion B are located at the same height, so that the inclination of each heat pipe is almost 0°. If, therefore, nitrogen is used as a working fluid, a proper operation can be performed.

FIG. 13B shows a structure in which the heat dissipating portion B is located at a level higher than that of the heat absorbing portion A in FIG. 13A so as to incline the above heat pipes.

According to this usage, a liquefied working fluid flows from the heat dissipating portion B into the heat absorbing portion A owing to the gravity, and the buoyancy of an air bubble generated at the heat absorbing portion A can be used as a driving force for the working fluid. A circulating force is therefore generated to act in the direction of the heat dissipating portion B, thus increasing the heat transport.

In addition to nitrogen, hydrogen, helium, and neon can therefore be used as working fluids.

In the second embodiment, a plurality of one-turn type heat pipes 21 are arranged side by side in the vertical direction. However, a single capillary tube 25 may be spirally wound a plurality of number of times into a coil-like structure.

Figure 14A:
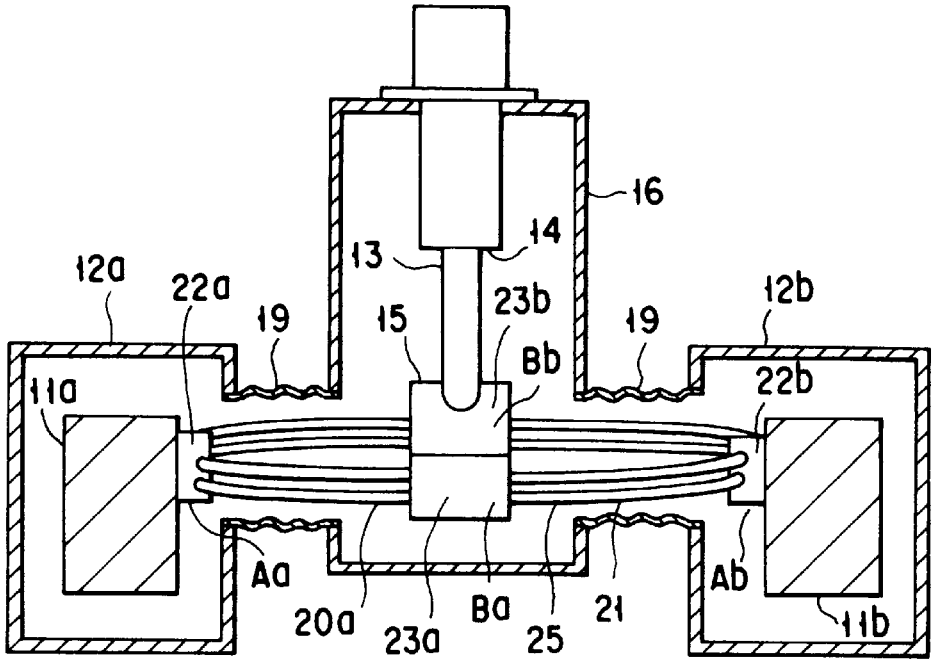
FIG. 14A is a sectional view showing the third embodiment of the present invention.
Figure 14B:
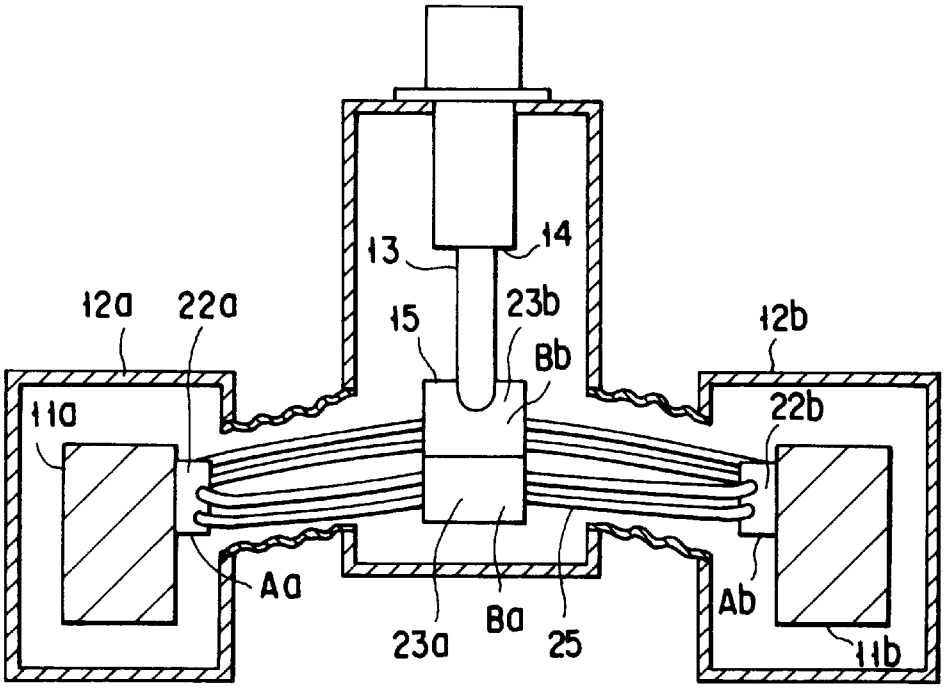
FIG. 14B is a sectional view showing a modification of the third embodiment.

FIGS. 14A and 14B show other application examples of the cryogenic loop heat pipe according to the present invention as the third embodiment. In this embodiment as well, the same reference numerals denote the same parts as in the first embodiment, and a detailed repetitive description thereof will be omitted.

In the example shown in FIG. 14A, one refrigerator 13 is used to cool two independent objects 11*a* and 11*b* to be cooled through one cryogenic loop heat pipe apparatus 20*a*.

Heat absorbing portions Aa and Ab are arranged at two places of each loop capillary tube 25 of the cryogenic loop heat pipe apparatus 20*a* in the circumferential direction. The heat absorbing portion Aa is thermally connected to the object 11*a* through a heat conduction member 22*a*. The heat absorbing portion Ab is thermally connected to the object 11*b* through a heat conduction member 22*b*. Heat dissipating portions Ba and Bb are arranged at places between the heat absorbing portions Aa and Ab of each loop capillary tube 25. These heat dissipating portions Ba and Bb form a common heat sink in the heat pipe and are thermally connected to a second cooling stage 15 of the refrigerator 13 through heat conduction members 23*a* and 23*b*.

According to this usage, the working fluid passing through the heat absorbing portion Aa is cooled first at the heat dissipating portion Ba, and then passes through the heat absorbing portion Ab. The working fluid is cooled at the heat dissipating portion Bb again, and then passes through the heat absorbing portion Aa again, thus circulating the pipe once (the working fluid may reverse in this route). With this operation, heat absorption and heat dissipation can be properly balanced, and the working fluid can be stably circulated.

In the example shown in FIG. 14B, the heat dissipating portions Ba and Bb are arranged at levels higher than those of the heat absorbing portions Aa and Ab in FIG. 14A so as to incline the capillary tubes 25.

According to this usage, the liquefied working fluid flows from the heat dissipating portion Ba into the heat absorbing portion Aa, and from the heat dissipating portion Bb into the heat absorbing portion Ab owing to the gravity, and the buoyancies of generated vapor bubbles can be used as driving forces for pushing the working fluid from the heat absorbing portion Aa to the heat dissipating portion Bb, and from the heat absorbing portion Ab to the heat dissipating portion Ba, thereby generating a circulating force. The heat transport can therefore be increased.

In the above heat pipe, hydrogen, helium, and neon can therefore be used as working fluids.

In the third embodiment, a plurality of one-turn type heat pipes 21 are vertically stacked. However, a single capillary tube 25 may be spirally wound a number of turns to form a coil-like structure. In addition, only a single one-turn heat pipe 21 may be used.

Assume that there are two or more independent objects to be cooled. This embodiment can also be applied to this case if the heat absorbing and dissipating portions of each loop capillary tube are alternately formed in the longitudinal direction of each tube.

Figure 15A:
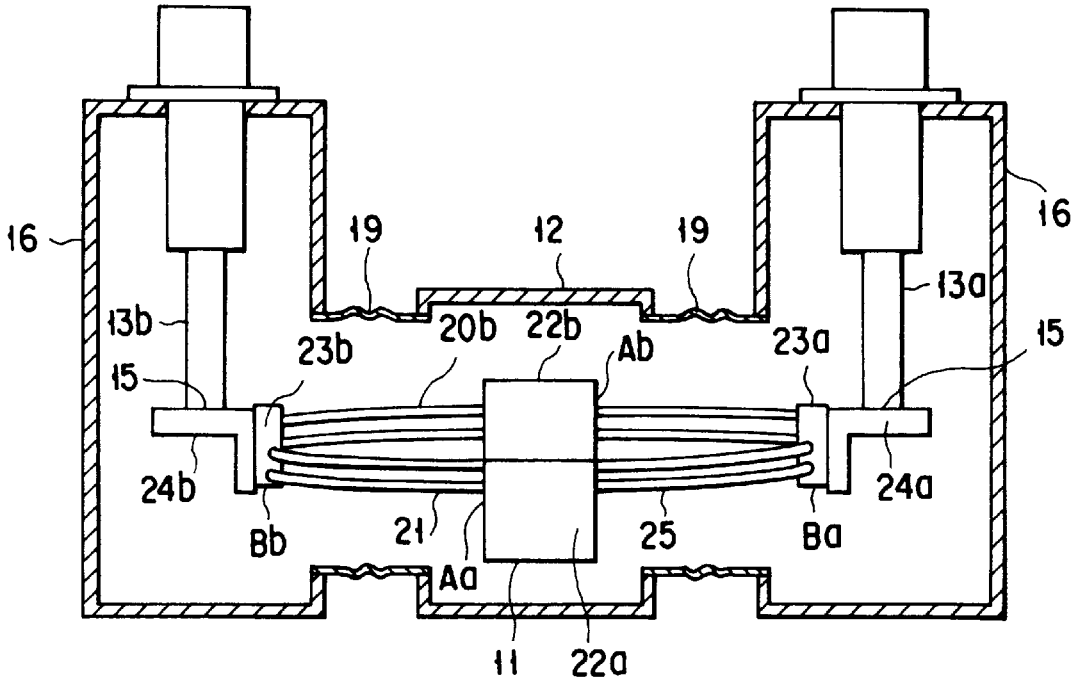
FIG. 15A is a sectional view showing the fourth embodiment of the present invention.
Figure 15B:
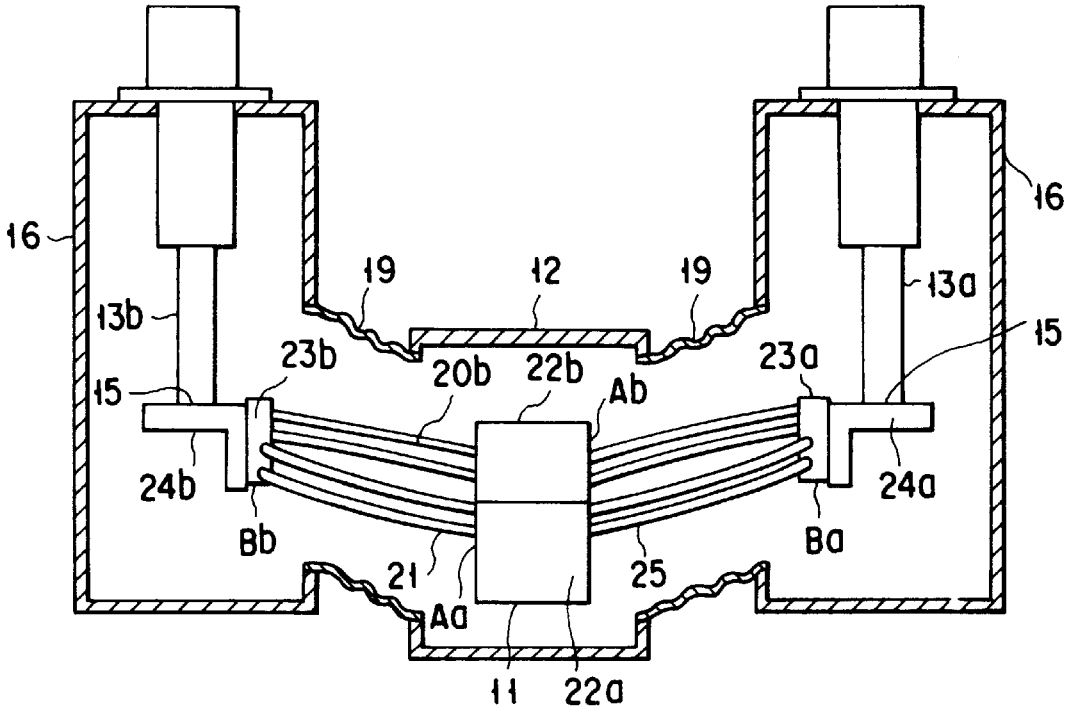
FIG. 15B is a sectional view showing a modification of the fourth embodiment.

FIGS. 15A and 15B show other application examples of the cryogenic loop heat pipe according to the present invention as the fourth embodiment. The same reference numerals in FIGS. 15A and 15B denote the same parts as in FIG. 1, and a detailed repetitive description thereof will be omitted.

In the example shown in FIG. 15A, two independent refrigerators 13*a* and 13*b* are used to cool one object 11 to be cooled through one cryogenic loop heat pipe apparatus 20*b*.

Heat dissipating portions Ba and Bb are formed at two places of each capillary tube 25 of the cryogenic loop heat pipe apparatus 20*b* in the circumferential direction of the heat pipe. The heat dissipating portion Ba is thermally connected to a second cooling stage 15 of the refrigerator 13*a* through heat conduction members 23*a* and 24*a*. The heat dissipating portion Bb is thermally connected to a second cooling stage 15 through heat conduction members 23*b* and 24*b*. Heat absorbing portions Aa and Ab are formed at places between the heat dissipating portions Ba and Bb of each capillary tube 25. These heat absorbing portions Aa and Ab form a common heat sink in the heat pipe and are thermally connected to the object 11 through heat conduction members 22*a* and 22*b*.

According to this usage, the working fluid passing through the heat absorbing portion Aa is cooled first at the heat dissipating portion Ba, and then passes through the heat absorbing portion Ab. The working fluid is then cooled at the heat dissipating portion Bb and passes through the heat absorbing portion Aa again, thus circulating the pipe once (the working fluid may reverse in this route). With this operation, heat absorption and heat dissipation can be properly balanced, and the working fluid can be stably circulated.

In the example shown in FIG. 15B, the heat dissipating portions Ba and Bb are formed at levels higher than those of the heat absorbing portions Aa and Ab in FIG. 15A so as to incline the capillary tubes 25.

With this usage, similar to the second embodiment, since the buoyancy of a vapor bubble can be used as a driving force for the working fluid, a circulating force is generated, thus increasing the heat transport.

In addition to nitrogen, in the above embodiment, hydrogen, helium, and neon can therefore be used as working fluids.

In the forth embodiment, a plurality of one-turn type heat pipes 21 are arranged side by side in the vertical direction. However, a single capillary tube 25 may be spirally wound a number of times to form a coil-like structure. In addition, only a single one-turn heat pipe 21 may be used.

This embodiment can also be applied to a case in which there are three or more refrigerators, and one object to be cooled.

Figure 16A:
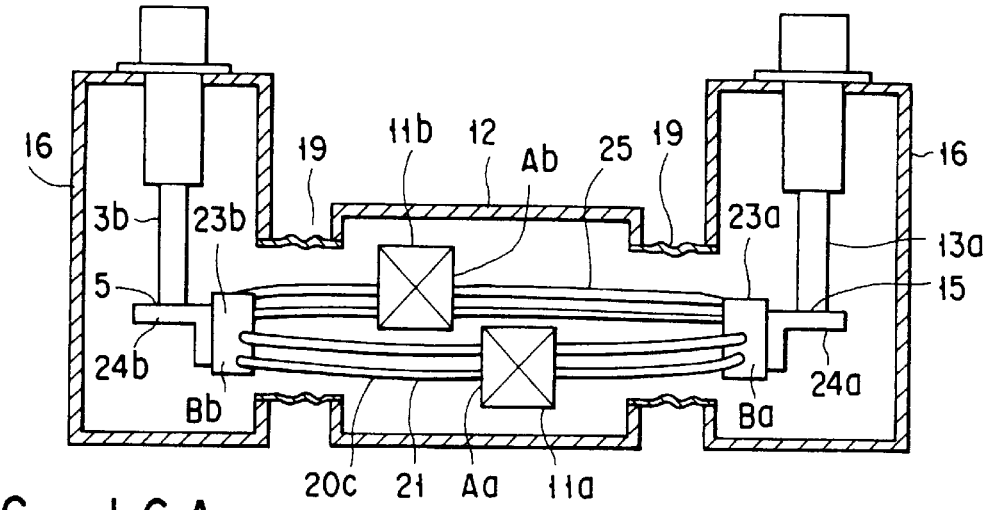
FIG. 16A is a sectional view showing the fifth embodiment of the present invention.
Figure 16B:
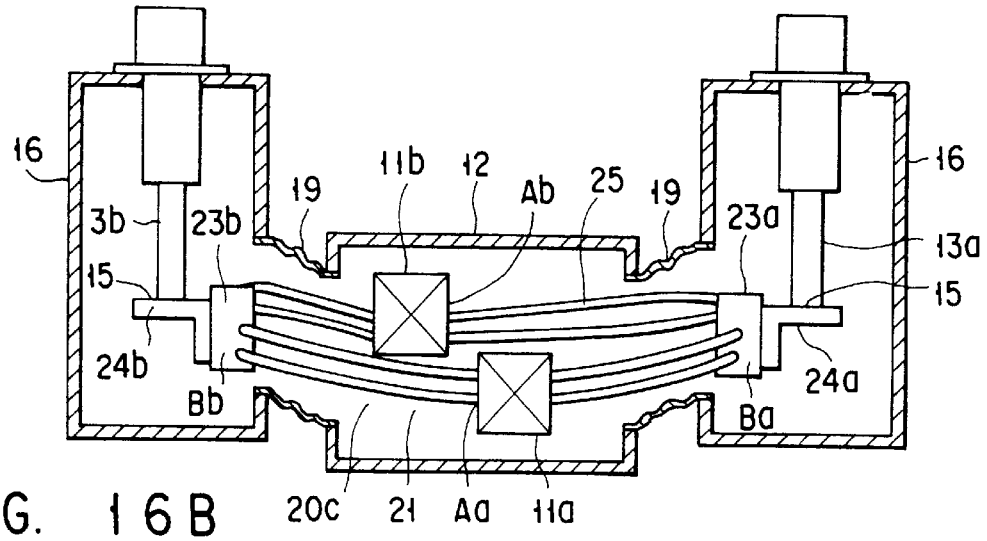
FIG. 16B is a sectional view showing a modification of the fifth embodiment.

FIGS. 16A and 16B show other application examples of the cryogenic loop heat pipe of the present invention as the fifth embodiment. The same reference numerals in FIGS. 16A and 16B denote the same parts as in FIG. 1 showing the first embodiment, and a detailed description thereof will be omitted.

In this case, two independent refrigerators 13*a* and 13*b* are used to cool objects 11*a* and 11*b* to be cooled through one cryogenic loop heat pipe apparatus 20*c*.

Heat dissipating portions Ba and Bb are formed at two places of each capillary tube 25 of the cryogenic loop heat pipe apparatus 20*c* in the circumferential direction of the heat pipe. The heat dissipating portion Ba is thermally connected to a second cooling stage 15 of the refrigerator 13*a* through heat conduction members 23*a* and 24*a*. The heat dissipating portion Bb is thermally connected to a second cooling stage 15 of the refrigerator 13*b* through heat conduction members 23*b* and 24*b*. Heat absorbing portions Aa and Ab are formed at places between the heat dissipating portions Ba and Bb of each loop capillary tube 25. The heat absorbing portion Ab is thermally connected to the object llb through a heat conduction member (not shown).

According to this usage, the working fluid passing through the heat absorbing portion Aa is cooled first at the heat dissipating portion Ba and then passes through the heat absorbing portion Ab. The working fluid is then cooled at the heat dissipating portion Bb and passes through the heat absorbing portion Aa again, thus circulating the pipe once (the working fluid may reverse in this route). With this operation, heat absorption and heat dissipation can be properly balanced, and the working fluid can be stably circulated.

In the example shown in FIG. 16B, the heat dissipating portions Ba and Bb are located at levels higher than those of the heat absorbing portions Aa and Ab in FIG. 16A so as to incline the capillary tubes 25.

According to this usage, similar to the second embodiment, since the buoyancy of a vapor bubble can be used as a driving force for the working fluid, a circulating force is generated, thus increasing the heat transport.

In addition to nitrogen, in the above embodiment, hydrogen, helium, and neon can therefore be used as working fluids.

In the fifth embodiment, a plurality of one-turn type heat pipes 21 are arranged side by side in the vertical direction. However, a single capillary tube 25 may be spirally wound in a number of turns to form into a coil-like structure. In addition, only a single one-turn heat pipe 21 may be used.

This embodiment can also be applied to a case in which there are three or more refrigerators, and the same number of objects to be cooled.

In each of the first to fifth embodiments, each heat dissipating portion is thermally connected to the cooling stage of the refrigerator. However, the present invention is not limited to this. For example, each dissipating portion may be thermally connected to a liquid refrigerant path, a liquid refrigerant reservoir, or a cool path.

Figure 17:
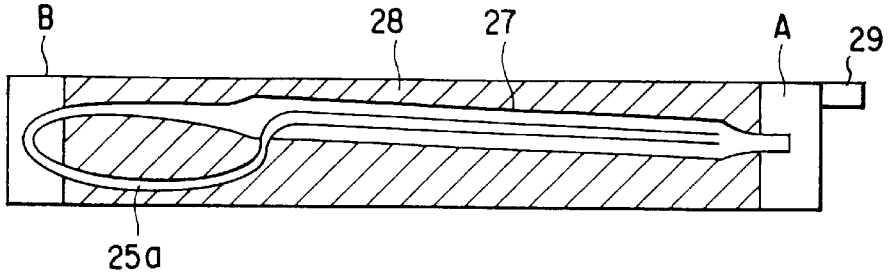
FIG. 17 is a sectional view showing the sixth embodiment of the present invention.

FIG. 17 shows the sixth embodiment in which the cryogenic loop heat pipe according to the present invention is applied to a medical cooling or a surgical tool.

This medical cooling tool has portions A and B in FIG. 17 which respectively serve as a heat absorbing portion and a heat dissipating portion. A loop capillary tube 25*a* between the heat absorbing portion A and the heat dissipating portion B is partly partitioned by a heat insulating wall to form a double pipe portion 27 forming outgoing and incoming paths. In this case, the tube portion between the heat absorbing portion A and the heat dissipating portion B is covered with a flexible heat insulating tube 28. The overall structure is therefore flexible. In addition, a heat absorbing piece 29 having a size and shape suited for medical treatments can be detachably mounted on the heat absorbing portion A.

The medical cooling tool having the above structure can easily perform intensive cooling with respect to a narrow morbid portion.

It should be noted that the above embodiments have been described as preferred embodiments of the present invention; some constituent elements can be omitted or other constituent elements can be added without departing from the spirit and scope of the invention. In addition, the applications of the present invention can be changed, as needed.

As has been described above, according to the present invention, there is provided a cryogenic loop heat pipe which can perform optimal heat transport in accordance with various operating temperature conditions. In addition, according to the usages of the present invention, the heat transport can further increased.

What is claimed is:

1. A cryogenic heat pipe, comprising:

a sealed tube having an inner diameter d where $L<d<3L$ configured to circulate a cryogenic working fluid having a surface tension $\sigma$, a liquid phase density $\rho_1$, a vapor phase density $\rho_v$, and a gravitational acceleration g, wherein L is the Laplace constant and $L=[\sigma/\{(\rho_1-\rho_v)g\}]^{0.5}$; and a vacuum container for containing the sealed tube, wherein said sealed tube comprises, at least one absorption portion configured to absorb heat and having a heat exchange length l where $\mathbf{15}d<l<\mathbf{882}d$, and at least one dissipation portion configured to dissipate heat;

wherein said working fluid is a fluid selected from the group consisting of helium, hydrogen, and neon and mixtures thereof.

2. The cryogenic heat pipe according to claim 1, wherein said sealed tube comprises as many of said absorption portions as there are objects to be cooled and as many of said dissipation portion as there are objects to be heated, said absorption portions and said dissipation portion alternately arranged along said sealed tube.

3. The cryogenic heat pipe according to claim 1, wherein said at least one absorption portion and said at least one dissipation portion comprise a heat conducting material.

4. The cryogenic heat pipe according to claim 3, wherein said heat conducting material is a metal.

5. The cryogenic heat pipe according to claim 1, wherein said sealed tube comprises one absorption portion and one dissipation portion and said one dissipation portion is positioned at a higher vertical level than said one absorption portion.

6. The cryogenic heat pipe according to claim 1, wherein said sealed tube comprises one absorption portion and one dissipation portion and said one absorption portion has an orientation angle having not less than a predetermined value with respect to a horizontal plane.

7. The cryogenic heat pipe according to claim 6, wherein said one absorption portion extends vertically with respect to said horizontal plane.

8. The cryogenic heat pipe according to claim 1, wherein said sealed tube further comprises a plurality of tubes formed into loops.

9. The cryogenic heat pipe according to claim 1, wherein said sealed tube further comprises a tube wound in a plurality of turns in the form of a coil.

10. The cryogenic heat pipe according to claim 1, wherein said sealed tube further comprises a double tube portion wherein one portion of said sealed tube is located within a second portion of said sealed tube, and an end portion of said one portion is open in said second portion.

11. The cryogenic heat pipe according to claim 1, wherein said cryogenic heat pipe is configured to use a super conductive coil for the heat absorption portion and a refrigerator for the dissipation portion.

* * * * *